US011751676B2

(12) United States Patent
Gunness

(10) Patent No.: US 11,751,676 B2
(45) Date of Patent: Sep. 12, 2023

(54) MAKEUP BRUSH

(71) Applicant: LUMETIQUE, INC., Irvine, CA (US)

(72) Inventor: Andrea Gunness, Gallatin, TN (US)

(73) Assignee: LUMETIQUE, INC., Irvine, CA (US)

( * ) Notice: Subject to any disclaimer, the term of this patent is extended or adjusted under 35 U.S.C. 154(b) by 132 days.

(21) Appl. No.: 16/700,754

(22) Filed: Dec. 2, 2019

(65) Prior Publication Data

US 2021/0120945 A1 Apr. 29, 2021

Related U.S. Application Data

(63) Continuation of application No. 16/139,099, filed on Sep. 24, 2018, now Pat. No. 10,820,684.

(51) Int. Cl.

| | |
|---|---|
| ***A46B 9/02*** | (2006.01) |
| ***A46B 3/02*** | (2006.01) |
| ***A46B 7/04*** | (2006.01) |
| ***A46B 3/06*** | (2006.01) |
| ***A46B 5/02*** | (2006.01) |
| ***A46B 5/00*** | (2006.01) |

(Continued)

(52) U.S. Cl.

CPC ..... *A46B 9/021* (2013.01); *A45D 33/00* (2013.01); *A45D 34/04* (2013.01); *A45D 40/26* (2013.01); *A46B 3/02* (2013.01); *A46B 3/06* (2013.01); *A46B 5/0095* (2013.01); *A46B 5/02* (2013.01); *A46B 7/042* (2013.01); *A46B 2200/1046* (2013.01)

(58) Field of Classification Search

CPC .... A46B 3/02; A46B 3/04; A46B 3/06; A46B 5/0095; A46B 5/02; A46B 7/042; A46B 9/021; A46B 2200/1046; A46D 3/00; A46D 3/045; A45D 33/00; A45D 34/04; A45D 2200/10; B29C 69/00; B29L 2031/42

See application file for complete search history.

(56) References Cited

U.S. PATENT DOCUMENTS 3,577,582 A * 5/1971 Aston ..... A45D 40/28 15/244.1
5,220,702 A * 6/1993 Howell ..... A46B 9/06 15/207.2

(Continued)

FOREIGN PATENT DOCUMENTS

| | | |
|---|---|---|
| EP | 1566116 A2 | 8/2005 |
| EP | 1894489 A2 | 3/2008 |
| JP | 2015503974 A | 2/2015 |

OTHER PUBLICATIONS

Screenshots of Amazon advertisement for KLIX makeup brushes, taken Sep. 25, 2019—although listed as "patent pending", Applicant has been unable to identify patent documents.

(Continued)

*Primary Examiner* — Randall E Chin
(74) *Attorney, Agent, or Firm* — Element IP, PLC

(57) ABSTRACT

The method for manufacturing a makeup brush includes: molding a ferrule and welding bristles to the ferrule. The ferrule includes a ferrule inner end; a ferrule outer end; a ferrule body; an interior; and a well. The well has a well base parallel to the ferrule outer end. The well base has an inner side and an outer side. The step of welding the bristles includes the steps of disposing the bristles in contact with the outer side of the well base and exposing the inner side of the well base to welding.

20 Claims, 11 Drawing Sheets

(51) Int. Cl.

| | |
|---|---|
| ***A45D 34/04*** | (2006.01) |
| ***A45D 40/26*** | (2006.01) |
| ***A45D 33/00*** | (2006.01) |

(56) References Cited

U.S. PATENT DOCUMENTS

| | | | | |
|---|---|---|---|---|
| 6,014,785 | A | 1/2000 | Punch | |
| 6,510,578 | B1 * | 1/2003 | Cyr | A46B 7/04 403/321 |
| 9,433,280 | B2 | 9/2016 | Hartstock | |
| 9,642,441 | B1 * | 5/2017 | Ajootian | A45D 40/28 |
| 2003/0005533 | A1 * | 1/2003 | Woodnorth | B05C 17/0205 D4/138 |
| 2005/0022326 | A1 * | 2/2005 | Lee | A46B 5/02 15/106 |
| 2008/0224528 | A1 | 9/2008 | Wang | |
| 2010/0095973 | A1 * | 4/2010 | Shrier | A46B 7/042 15/160 |
| 2010/0101035 | A1 * | 4/2010 | Nakamura | A46B 9/021 15/160 |
| 2011/0023249 | A1 | 2/2011 | Boucherie | |
| 2012/0298130 | A1 * | 11/2012 | Telwar | A46D 3/00 132/317 |
| 2015/0026905 | A1 | 1/2015 | Jensen | |
| 2020/0015579 | A1 * | 1/2020 | Barad | A46B 9/021 |

OTHER PUBLICATIONS

International Search Report dated Jan. 2, 2020 in PCT/US2019/052575, 2 pages.

Written Opinion dated Jan. 2, 2020 in PCT/US2019/052575, 8 pages.

U.S. Final Office Action dated Oct. 20, 2022 in U.S. Appl. No. 16/846,466, 9 pages.

* cited by examiner

MAKEUP BRUSH

CLAIM OF PRIORITY

This application is a continuation in part of and claims the benefit of priority of co-pending U.S. patent application Ser. No. 16/139,099, filed on Sep. 24, 2018, now U.S. Pat. No. 10,820,684.

FIELD OF THE INVENTION

The present invention relates to cosmetic application technology, and in particular, to the manufacture of an improved makeup brush and makeup brush itself.

BACKGROUND

Brushes of varying types have almost universal utility, from industrial uses, to personal uses, to artistic endeavors, etc. The bristles of these various brushes may be made of a wide variety of materials, including hair, fur, synthetic filaments, etc. What all of these brushes have in common is that the bristles tend to fall out with use.

Most brushes have a metal or plastic ferrule that hold the bristles in the brush. The bristles are glued or tied within the ferrule to hold them in place. Incomplete gluing during manufacture may cause the bristles to fall out of the brush during use. High-end brushes often maintain their bristles better because they are laid into the ferrule by hand. This requires time-consuming gluing and securing of the bristles, but does result in a better product in so far as bristle loss. Even this, however, is not a complete solution, as the brush will ultimately still lose bristles. Obviously, if the brush loses all of its bristles, it will also have lost all of its utility in that capacity. The loss of only some bristles will not necessarily greatly affect the utility of the brush, however. The loss of the bristles does interfere with the purpose of the application though. The material being applied by the brush and the surface to which the material is being applied may become contaminated with bristles lost from the ferrule.

A further disadvantage in the current design of brushes is that contamination by the glue usually make the bristles and brush non-recyclable or reusable. Another disadvantage is inevitable bacterial contamination of the bristles over time. Regular cleaning of the brushes requires specialized products in which the brushes must be immersed. After this immersion, the brushes must dry. All in all, the cleaning is an expensive and time-consuming process. Moreover, the cleaning process further breaks down the shape and structure of the brush, as well as the glue holding the bristles in place within the ferrule. This ends up exacerbating the original problem discussed above, of bristle loss. In short, even the most expensive and carefully laid-in brush will eventually degrade to the point where it must be replaced. Unfortunately, these unusable brushes are then deposited in landfills, as there is no way to recycle these items.

At least one company, GEKA GmbH has recognized these problems and taken steps to address them. While they have several technologies relevant to these problems, the most relevant reference is U.S. Pat. No. 9,433,280. This patent discloses a molded lip brush whose bristles are integrally injection molded onto its distal end. Although this disclosure may address the problem of the brush losing bristles, it includes additional features, such as a bending element that is flexible in at least one plane, which makes the brush complicated and expensive, and likely still not recyclable. In addition, creating the molds for injection molded bristles may make this product cost prohibitive.

At least one makeup brush manufacturer has developed a makeup brush with detachable or separable handles and brush heads. These makeup brushes were sold under the trademark KLIX. Considering the overall brush length of a brush to extend from the tip of the handle that would be held by the user to the tip of the ferrule, from which the bristles extend, the ratio of the ferrule length to the brush length of such makeup brushes was typically approximately 1:3 to 1:4. The ferrule therefore takes up a significant portion of the length of the handle, making the gripping portion less significant in the overall structure and less valuable. With the ferrule being so long, a user could, in fact, use just the ferrule as a handle, making the gripping portion unnecessary and obsolete. The manufacture of such makeup brushes with very long ferrules as compared to the overall brush length makes the makeup brush easier to manufacture and easier to make as a "universal fit" between ferrules and gripping portions, but has the disadvantages mentioned above. Moreover, at least the outside of the ferrules in such makeup brushes are made of metal. Metal ferrules are hollow and require additional structures within the outside covering to allow for the well within the ferrule to which the bristles are attached and from which the bristles extend. With the metal outside of the ferrule needing to be held together with the inside structures, including the well, on top of the bristles being glued into the well, the possibility of the ferrule falling apart is quite high. Finally, the makeup brushes sold under the trademark KLIX did not include a flat base so that the separated ferrule could be set on a flat surface so that it stood on its own, with the bristles facing up and not in contact with the surface.

Therefore there is a need for a makeup brush that is inexpensive to produce; does not lose bristles; is entirely recyclable; maintains a small ratio of ferrule head to overall brush length; and includes several brush heads that may be used for different applications and that may be replaced over a universal handle.

SUMMARY OF THE INVENTION

The present invention is a method for manufacturing an improved makeup brush and the makeup brush manufactured from the method. Although all references herein are to a makeup brush, it is understood that the use of the brush of the present invention need not be limited to makeup application.

In its most basic form, the method for manufacturing an improved makeup brush includes the following steps: molding a ferrule and welding bristles to the well of the ferrule. The ferrule includes a ferrule inner end; a ferrule outer end; a ferrule body with a length extending between the inner and outer ends; an interior; and a well. The well has a well base parallel to the ferrule outer end. The well base has an inner side that faces the interior of the ferrule body and an outer side that faces the ferrule outer end of the ferrule. Each of the bristles includes a bristle outer tip, a bristle inner tip, and a length extending between the bristle outer and inner tips. The step of welding the bristles includes the steps of disposing the bristle inner tips in contact with the outer side of the well base of the ferrule; and exposing the inner side of the well base of the ferrule to welding.

It is preferred that the step of molding the ferrule is accomplished by injection molding, but other types of molding common in the art may be substituted. In preferred embodiments, the well base of the well is set slightly within the interior of the ferrule body. In such embodiments, the well also includes well sides connecting the well base to the ferrule outer end.

It is also preferred that the ferrule include means for connecting the ferrule to a handle of the makeup brush. The connecting means are preferably releasable connecting means. The preferred releasable connecting means are snapping features on each of the ferrule and the handle of the makeup brush, where the ferrule and handle snapping features mate with one another. The preferred ferrule snapping feature is an indentation extending inward from the interior of the ferrule body, which mates with a protrusion extending outward from the handle, which is the handle snapping feature. In another embodiment, the snapping features are reversed so that the ferrule snapping feature is a protrusion extending into the interior of the ferrule body and the handle snapping feature is an indentation that mates with the protrusion. Another means for connecting the ferrule to the handle would be by including mateable threading on each of the ferrule and handle so that they may be screwed together. One of at least ordinary skill in the art will recognize not only that there are many specific embodiments in which these snapping features may be formed, but also that the connecting means take various forms other than as snapping features. Each of these connecting means, whether they are snapping features are not, are contemplated as being within the scope of this invention.

It is preferred that the welding of the bristles to the ferrule base is through infrared, ultrasonic, or laser welding. Importantly, the welding (of whatever type) is applied to the other side of the well base than that from which the bristles extend. Specifically, the inner end of the bristles are disposed in contact with the outer side of the well base, while the welding is applied to the inner side of the well base. The energy of the welding extends through the well base so that the bristle inner ends become integrated with the outer side of the well base. As such, the bristles are never directly exposed to the welding. As the various types of welding may be fairly intense, this protects the bristles from that direct force or energy. Other types of welding than those listed above may be substituted, however, as may other forms of integration, such as injection molding. By integrating the bristles into the ferrule through welding, the ferrule and bristles become as one piece with no seams and no need for additional adhesion, such as with glue, or binding, such as with ties. As such, the bristles cannot fall out of the ferrule, and a disadvantage of the prior art is overcome. It is understood, however, that in some embodiments, the bristles may be glued into the ferrule, as with prior art. In such embodiments, the ferrule and brush remain novel for their additional structures and features.

It is preferred that the material out of which the ferrule and the bristles are made is a recyclable material, such as polybutylene terephthalate (PBT), which is a thermoplastic engineering polymer. Other polymers, and especially elastomers, such as those sold under the trademarks HYTREL and GRILFLEX, may be substituted. In addition, the material should be easily cleanable, including being at least somewhat heat and chemical resistant. As the ferrule and bristle combination is preferably recyclable, another disadvantage of the prior art is overcome. As such, while the word "ferrule" may imply that it is made of metal, this is not necessarily the case, and although it may be made of metal, such embodiments are not preferred. In non-preferred embodiments where the ferrule body is made of metal, the well and well sides may also be formed of metal, but are preferably made of one of the plastics described above, allowing for the welding of the bristles to the well base, also as described above. In embodiments where the entire ferrule, including the ferrule body, the well, and the well sides, is made of metal, the bristles are preferably glued into place.

Even if the ferrule does eventually become unusable or undesirable for whatever reason, the ferrule may be recycled while the handle of the makeup brush is continually reused, as the handle and the ferrule inner ends of the ferrules, which connect to the handle, are standardized so that ferrules may be easily swapped out. In this way, one piece, the ferrule, is recycled, and the other piece, the handle, is reused—no part of the makeup brush ends up cluttering a landfill. In addition, plastics, such as those preferred with respect to the present invention, are easily cleaned and may be fairly rigorously cleaned without fear of the bristles falling out. Another disadvantage of the prior art is thus overcome. All of these factors weigh toward an inexpensive product, both to purchase and to maintain.

In its most basic form, the makeup brush of the present invention includes a handle, a ferrule, and a plurality of bristles. The handle has a ferrule end and a holding end. The ferrule includes a ferrule inner end connected to the ferrule end of the handle, a ferrule outer end, an interior, a ferrule body with a length extending between the inner and outer ends and around the interior, and a well at said ferrule outer end, where the well comprises a well base parallel to the ferrule outer end. The well base includes an inner side that faces the interior of the ferrule body and an outer side that faces the ferrule outer end of the ferrule. Each of the plurality of bristles includes a bristle outer tip, a bristle inner tip, and a length extending between the bristle outer and inner tips. The bristles extend out of the ferrule such that the inner tips of the bristles are integrally attached to the outer side of the well base of the ferrule.

The makeup brush has a brush length that extends between the ferrule end and the holding end. The brush length includes the ferrule length, as well as the length of the gripping portion, which extends from the end of the ferrule length to the holding end. The ratio of the ferrule length to the overall brush length is less than or equal to 20% or 1:5. In some embodiments of the makeup brush that have specific uses, the ratio may be less than or equal to 25% or 1:4. To manufacture a separable ferrule and gripping portion to these specifications is difficult, if not impossible with a metal ferrule. Through intensive experimentation, the inventor was able to produce a makeup brush with these proportions through the injection molding process, described above. The novelty of this process is therefore expressed in the structure of the ratio. Aesthetically, it gives the overall makeup brush the look of a standard non-separable makeup brush. Functionally, however, maintaining this ratio with a separable ferrule and handle is a complicated process that has not been achieved prior to the present invention.

It is preferred that the ferrule inner end, i.e. the end of the ferrule that attaches to the handle has a flat base, so that the ferrule may stand up on a surface. As used herein, when it is said that the ferrule inner end has a "flat base" it is understood that ferrule inner end is structured such that when the ferrule is placed on a flat surface, with the ferrule inner end contacting the surface, the ferrule will stand up straight, with the bristles facing upward. For the avoidance of doubt, the flat base does not necessarily require that the ferrule inner end have an unbroken perimeter. That is to say, as discussed below, the ferrule inner end may include a cutout, as discussed below, while stilling maintaining a flat base that would solidly sit on a flat surface. This feature is useful in that any residual makeup in the bristles of the ferrule will not be put in direct contact with the surface, so the surface will remain clean. Similarly, any dirt on the surface will not come in contact with the bristles, thereby keeping the bristles clean as well. This feature is facilitated by the relatively short ferrule length. While the inventor has no knowledge of a longer ferrule that includes a flat base, even if one existed, it would teeter if set on a flat surface, and likely fall, thereby diminishing the advantages of the flat base discussed above. The shorter ferrule lengths of the ferrule of the present invention therefore make the ferrule more stable for the purpose of setting the flat base on a flat surface.

In preferred embodiments of the makeup brush of the present invention where the ferrule and handle are releasably connected, the ferrule also includes a ferrule disc disposed within the interior of the well body and a handle disc disposed on said ferrule end of the handle. The ferrule disc includes at least one ferrule disc guiding feature and the handle disc comprises at least one handle disc guiding feature. The ferrule disc guiding feature and the handle disc guiding feature are designed to mate with one another so as to guide the handle and the ferrule into proper alignment for connection. As used herein, the term "disc" should be interpreted in its common usage, as a relatively thin, flat plate. The handle disc and the ferrule disc will mimic the sizes and shapes of the ferrule end of the handle and the ferrule inner end of the ferrule to which the discs are attached, respectively. As both the ferrule and the handle are preferably rounded, the term "disc" will also preferably indicate a round shape. It is preferred that the ferrule and handle discs be made of the same material as the ferrule and handle, respectively, but other materials may be used.

It is preferred that the at least one handle disc guiding feature be at least one handle alignment slot and the at least one ferrule disc guiding feature be at least one ferrule alignment tab or that the at least one handle disc guiding feature be at least one handle alignment tab and the at least one ferrule disc guiding feature be at least one ferrule alignment slot. Although corresponding tabs and slots are the preferred embodiments of the disc guiding features, one of ordinary skill in the art will recognize that the guiding features may take other forms, and each of these forms are considered to be within the scope of the present invention. It is preferred that the at least one tab (whether be a ferrule alignment tab or a handle alignment tab) and the at least one slot (whether it be a ferrule alignment slot or a handle alignment slot) be two tabs and slots and that these two tabs and slots are of different sizes. The different sizes ensure that the ferrule and the handle are placed together in a preferred orientation. With some embodiments of the makeup brush of the present invention, i.e. symmetric versions, a specific orientation is not necessary. Some makeup brushes of the present invention, especially those that are very specialized for a specific task, however, may be tapered or trimmed in a certain way that would make one orientation of the ferrule and the handle preferable. It is understood that the discs themselves with their alignment slots or tabs are largely arbitrary as to whether they are handle discs or ferrule discs, so long as the respective guiding features correspond with one another. That said, it is preferred that the ferrule disc include ferrule alignment tabs and that the handle disc include handle alignment slots, as ferrule alignment slots may take up too much room within the ferrule and get in the way of bonding the bristles to the well base.

In some embodiments of the handle disc or ferrule disc that includes at least one slot, the disc is flat and the slots extend through the disc. In other embodiments, however, such discs may have a disc depth. In such embodiments, the slots do not extend all the way through the disc but are molded into the disc as allowed for by the disc depth. These discs stray slightly from the common view of a disc being completely flat, but they are considered part of the meaning of the term as used herein.

In some embodiments of the makeup brush of the present invention, the handle includes a barrel space disposed behind the ferrule end of the handle and extending into the handle body of the handle. The handle body is the body of the handle extending between the ferrule end and the holding end of the handle. The barrel space has a barrel wall that faces inward toward the interior of the handle body. It is preferred that in such embodiments, the barrel wall includes at least one, and preferably three, barrel guides and the handle disc (whether it includes handle alignment slots or handle alignment tabs), includes at least one, and preferably three, disc guides. The barrel guides and the disc guides are sized and dimensioned to mate so as to securely hold the disc against the ferrule end of the handle in a preferred orientation. It is preferred that the barrel guides are protrusions extending slightly out from the barrel wall and the disc guides are slight indentations in the disc perimeter. It is understood that the barrel and disc guides may take other forms, however. They may be corresponding threading for example. Each of these variations are considered to be aspects of the present invention.

In other embodiments, however, the handle disc is integral to the handle, i.e. the handle disc may be included as part of the mold of the entire handle. The handle disc may also be glued or welded to the ferrule end of the handle. The ferrule disc may also be integral to the interior of the ferrule or attached thereto. It is preferred that it is integral.

In some embodiments of the makeup brush of the present invention where the ferrule and handle are releasably connected, the makeup brush includes additional features to ease the separation and connection of the ferrule and the handle. In one such preferred embodiment, the ferrule end of the handle includes a narrow portion that will be inserted into the ferrule inner end of the ferrule for connection. Just below this narrow portion, still at the ferrule end, the handle also includes a wide portion. The narrow portion has a narrow diameter and the wide portion has a wide diameter. The narrow diameter is less than the wide diameter. The perimeter of the wide portion, which may be a circumference when the handle is round, forms a handle lip. The edge of the ferrule inner end of the ferrule forms a ferrule lip. The ferrule lip has a ferrule lip diameter equal to the wide diameter. As such, when the ferrule and the handle are joined, the handle lip and the ferrule lip are flush. The preferred connecting means are a handle snapping feature that is a protrusion around the narrow portion of the handle and a ferrule snapping feature that is a corresponding indentation within the ferrule body of the ferrule.

In some embodiments, the protrusion does not extend all the way around the narrow portion of the handle. In such embodiments, the narrow portion has a protrusion section where the protrusion is present and an empty section where it is not. The narrow portion has a narrow portion wall out from which the protrusion extends. It is preferred that the narrow portion wall include thinning in the empty section. That is to say, it is preferred that the narrow portion wall have inconsistent thickness and that it is thinner at the empty section where the protrusion is not present. At this thinning, it is also preferred that the narrow portion wall curve slightly inward, rather than being a straight wall as it may be at other locations, such as at the protrusion section. This slight curve inward along a radius allows the narrow portion at the thinning to be caught more easily behind the ferrule lip of the ferrule. The thinning makes the narrow portion of the handle more flexible in that area and therefore more easily manipulated off of the handle during release.

In some embodiments, the ferrule lip includes a thumb eyebrow. As used herein, a "thumb eyebrow" means a protrusion out from the ferrule lip. The thumb eyebrow may extend all the way around the ferrule lip, but is preferably a small protrusion, just big enough to catch with one's thumb. The purpose of the thumb eyebrow is to give some texture to the otherwise fairly smooth surface of the makeup brush. It allows a user to catch the surface of the ferrule and push it away from the handle easily with the user's thumb, to effect a separation of the handle and ferrule. In embodiments that include a thumb eyebrow, it is preferred that the ferrule lip include a cutout and the handle lip include a filler that is sized and dimensioned to mate with the cutout. That is to say, the ferrule lip is not an unbroken line, but instead includes a shape cutout of the otherwise continuous ferrule lip. Similarly, the handle lip is not an unbroken line, but instead includes a filler shaped to mate with the cutout. Given the tradedress of the makeup brush of the present invention as of this writing, the preferred shape of the cutout and filler is a hemisphere, but it is understood that any shape may be used. The purpose of the cutout and filler is to guide the handle and ferrule together in a specific orientation. It is understood that cutout and filler are used interchangeably in this context. That is to say that while the words would indicate the shape is literally cut out of the ferrule lip and the filler of the handle lip literally fills the shape left from the cut out, it is understood that the filler of the handle lip could be the indentation and the cutout of the ferrule lip could be shape that fills the indentation. It is preferred that the thumb eyebrow be disposed directly over the cutout of the ferrule lip and that the thumb eyebrow mimic the shape of the cutout. In embodiments that do not include a cutout and filler, it is preferred that the thumb eyebrow be flat and parallel to the ferrule lip.

It is understood that various embodiments of the makeup brush of the present invention will include various features disclosed above. The preferred makeup brush, however, includes a ferrule disc with two ferrule alignment tabs of different sizes; a handle disc with two handle alignment slots of coordinating different sizes and a barrel space with three barrel guides to guide the handle disc with three coordinating disc guides so that the handle disc is guided into place on the ferrule end of the handle; a narrow portion of the ferrule end of the handle with a protrusion section that does not extend all the way around the narrow section, and a thinning of the narrow portion wall in the empty section that curves slightly inward; a cutout on the ferrule lip and a corresponding filler on the handle lip; and a thumb eyebrow above the cutout, mimicking its shape.

The makeup brush of the present invention is preferably a product of the method of the present invention. As such, several features discussed above with reference to the method of the present invention also apply to the makeup brush of the present invention, including that: the well of the ferrule is preferably set within the ferrule, but may be flush with the ferrule outer end; the handle and ferrule are releasably connectable and include means, such as mateable snapping features or threading, for achieving such releasable connectivity; the bristles are welded to the well base of the ferrule; and the ferrule and bristles are made of the same recyclable material, preferably PBT or another polymer. In addition, each of the ferrule outer and inner ends has a diameter. In some embodiments, the ferrule outer diameter is less than the ferrule inner diameter. That is to say, the ferrule tends to taper from where it connects with the handle to its ferrule outer end. It is also preferred that the ferrule outer end be round, such as circular or elliptical in shape. It is also preferred that the handle taper from the ferrule end to the holding end, so that the holding end is smaller than the ferrule end.

Therefore it is an aspect of the present invention that the ferrule is molded, preferably by injection molding.

It is a further aspect of the present invention that the bristles of the brush are made of the same material as the ferrule.

It is a further aspect of the present invention that the bristles of the brush are made integral with the ferrule through welding or other means.

It is a further aspect of the present invention that the ferrule is removable from the handle of the brush.

It is a further aspect of the present invention that the ferrule and handle include corresponding features so that they are releasably mateable, such as indentations and protrusions for snapping the ferrule and handle together or threading for screwing the ferrule and handle together.

It is a further aspect of the present invention that the ferrule and bristles be made of a recyclable material.

It is a further aspect of the present invention that the recyclable material out of which the ferrule and bristles are made is PBT or another polymer, such as thermoplastic elastomers or polymide high performance elastomers.

It is a further aspect of the present invention that the ferrule and bristles be easily cleanable and that cleaning does not break down the shape or structure of the bristles.

It is a further aspect of the present invention that the outer end of the ferrule has a smaller diameter than the inner end of the ferrule.

It is a further aspect of the present invention that the outer end of the ferrule is round in shape, such as circular or elliptical.

It is a further aspect of the present invention that the handle of the makeup brush tapers so that it is larger at its ferrule end and smaller at its holding end.

These aspects of the present invention are not meant to be exclusive and other features, aspects, and advantages of the present invention will be readily apparent to those of ordinary skill in the art when read in conjunction with the following description and accompanying drawings. Although not every feature may be initially claimed, each feature is considered to be a part of the present invention.

DETAILED DESCRIPTION

Figure 1:
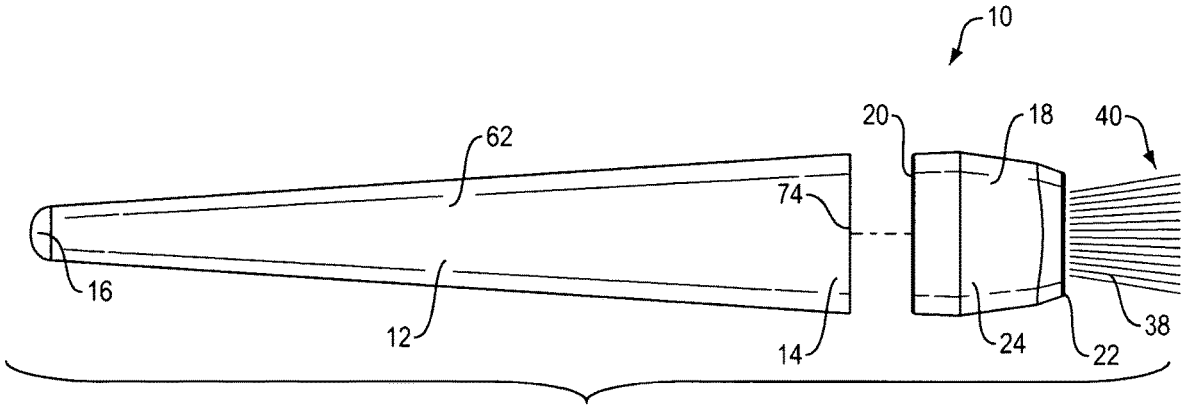
FIG. 1 is a side view of a makeup brush of the present invention.

Referring first to FIG. 1, a side view of a makeup brush 10 of the present invention is provided. Makeup brush 10 includes handle 12 and ferrule 18. Handle 12 has ferrule end 14, where handle 12 connects to ferrule 18, and holding end 16, where a user will hold handle 12. Handle 12 preferably tapers 62 from ferrule end 14 to holding end 16 so that ferrule end 14 is wider than holding end 16. It is understood, however, that handle 12 may be uniform in width. Handle 12 may include cap 74 that covers ferrule end 14. Ferrule 18 includes ferrule inner end 20, which connects with ferrule end 14 of handle 12, and ferrule outer end 22, which faces away from handle 12. Ferrule 18 also includes ferrule body 24. Although shown more clearly in FIG. 2A, it is understood that ferrule body 24 has an interior 68 and well 28. Bristles 38 with bristle outer tips 40 extend from ferrule outer end 22. Throughout these FIGS., the discussion focuses on handle 12 and ferrule 18 being separate pieces that may be releasably connected. It is understood, however, that in some embodiments, handle 12 and ferrule 18 are a single, permanently integrated makeup brush 10.

Figure 2A:
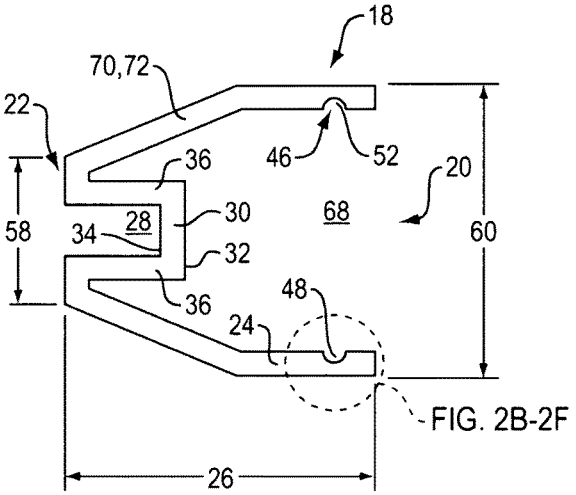
FIG. 2A is a side cutaway diagram of a ferrule of a makeup brush of the present invention.
Figure 8A:
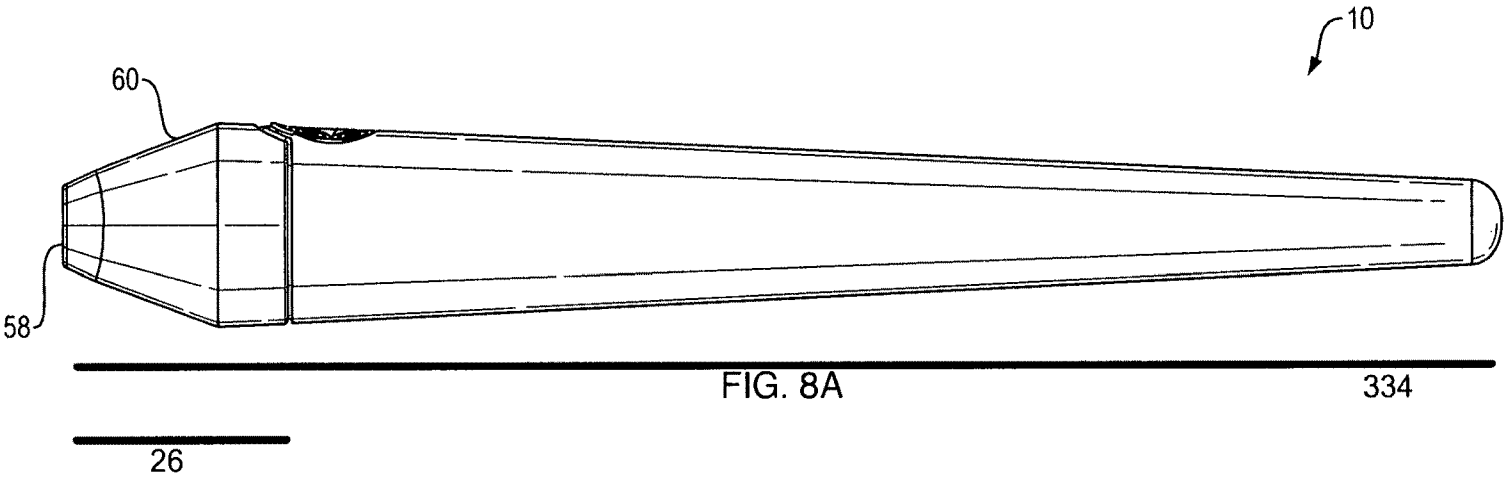
FIGS. 8A-8C are various views of a second embodiment of the makeup brush of the present invention.
Figure 8C:
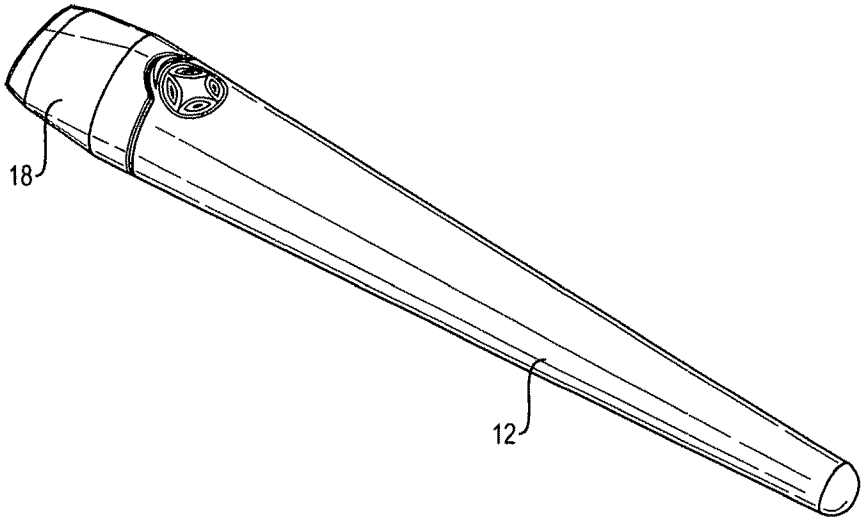
Figure 8B:
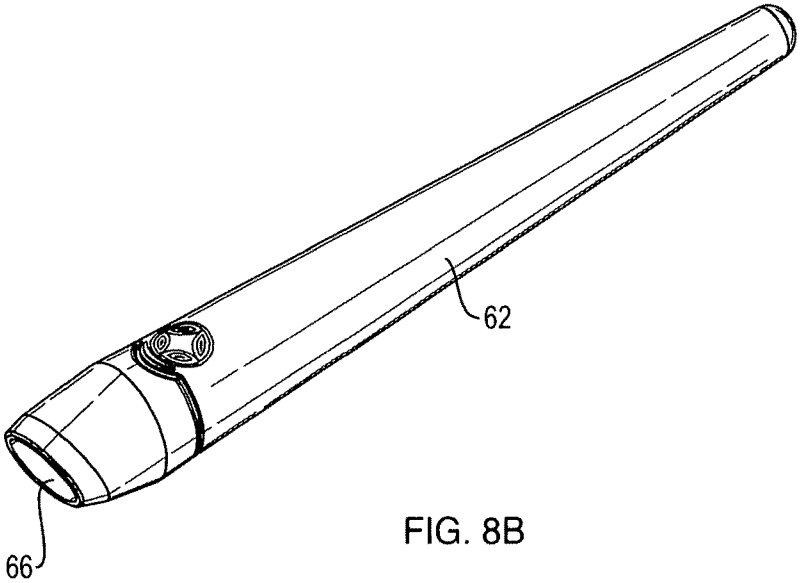
Figure 9A:
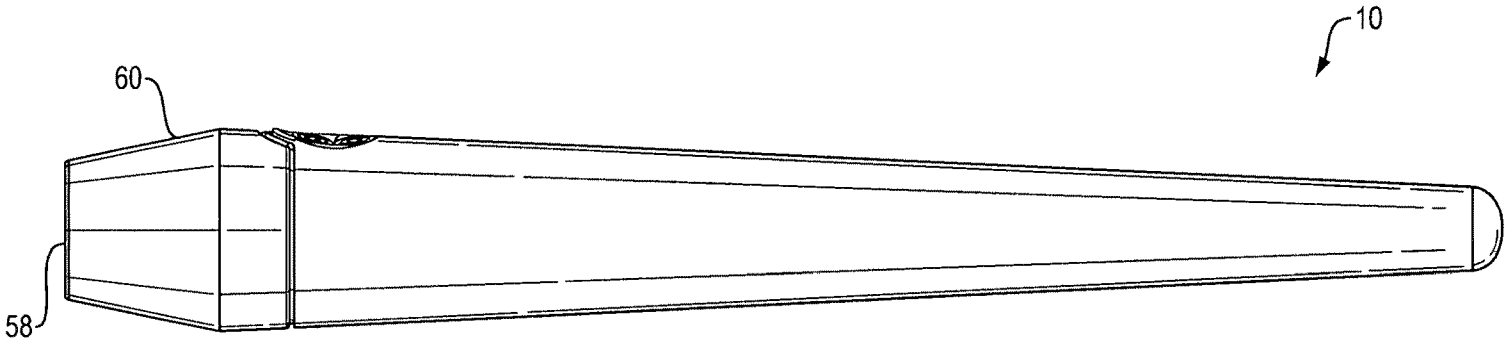
FIGS. 9A-9C are various views of a third embodiment of the makeup brush of the present invention.
Figure 9C:
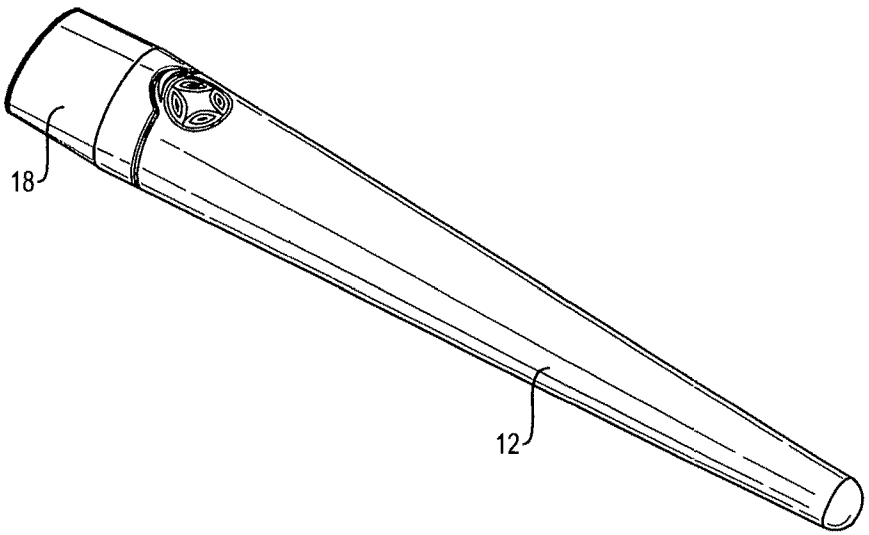
Figure 9B:
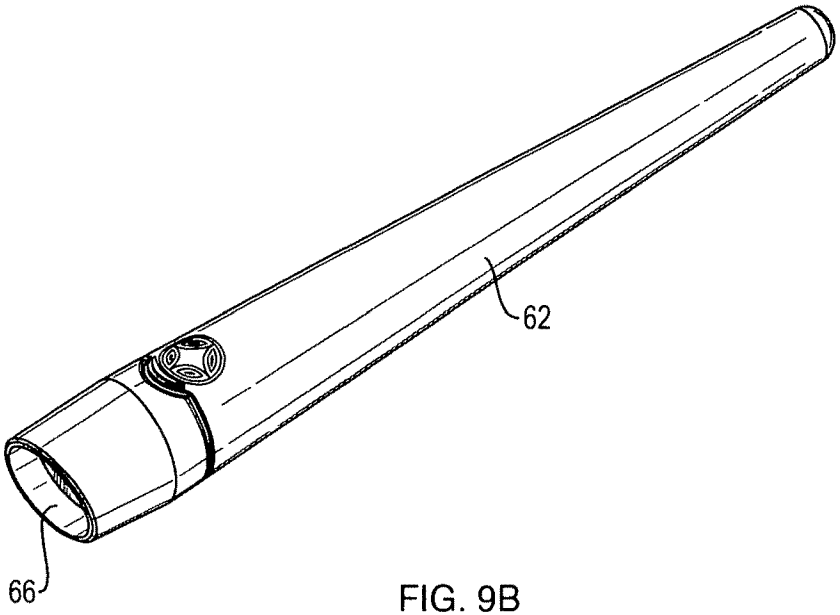
Figure 10A:
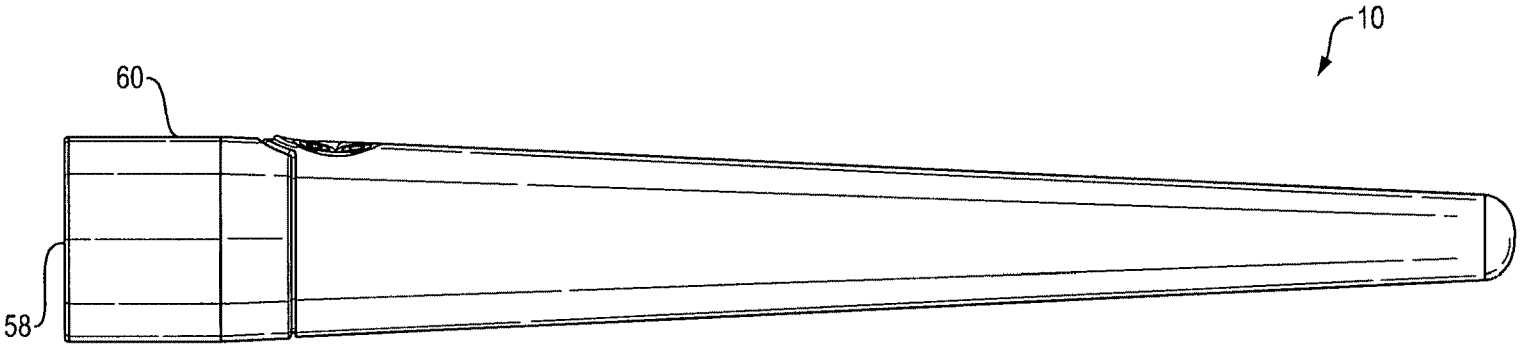
FIGS. 10A-10C are various views of a fourth embodiment of the makeup brush of the present invention.
Figure 10B:
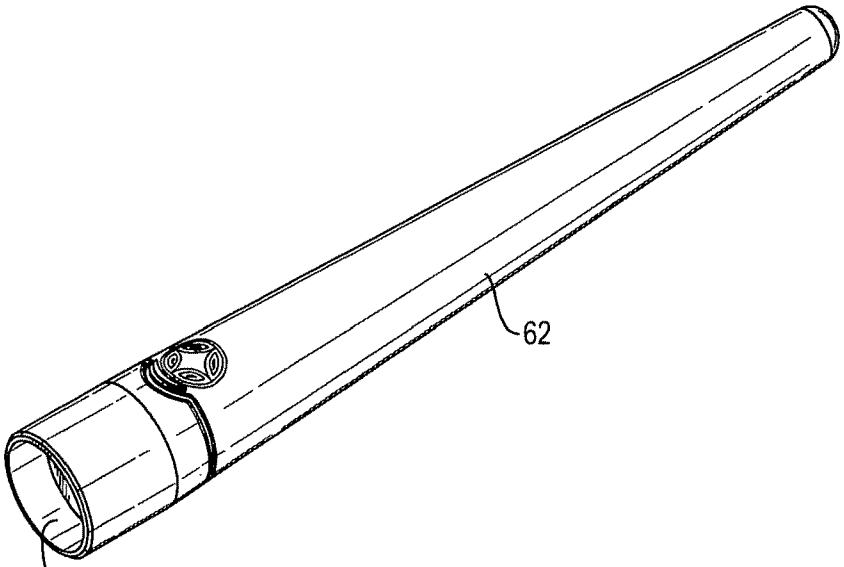

Now referring to FIG. 2A, a side cutaway diagram of ferrule 18 is provided. Ferrule outer end 22 has diameter 58. Ferrule inner end 20 has diameter 60. As shown, and as preferred, diameter 58 of ferrule outer end 22 is less than diameter 60 of ferrule inner end 20. Ferrule 18 has ferrule length 26, extending between ferrule inner end 20 and ferrule outer end 22. Brush length 334 (shown in FIG. 8A) is the length of makeup brush 10 as measured from ferrule outer end 22 of ferrule 18 to holding end 16 of handle 12, when ferrule 18 and handle 12 are united. In most embodiments of makeup brush 10 of the present invention, the ratio of ferrule length 26 to brush length 334 is less than or equal to 1:5 or 20%. In some embodiments of makeup brush 10, the ratio is significantly less than 20%. As shown in FIG. 10A, for example, the ratio is approximately 1:6 or 17%. Some makeup brushes 10 have a slightly higher ratio of 1:4 or 25%.

As mentioned above, in some embodiments, makeup brush 10 is an integrated brush where handle 12 is a single piece extending between holding end 16 and ferrule outer end 22 and not detachable. In such embodiments, ferrule 18 may include only well 28 with well sides 36 and bristles 38 extending out from well base 30, where 18 bristles 38 may be dropped into ferrule outer end 22 and secured thereto. This limited ferrule 18 is preferably formed by the method 100 of the present invention.

Ferrule 18 is preferably made of recyclable material 70, such as PBT 72. In this view, we see well 28. Well 28 is disposed parallel to ferrule outer end 22. In the embodiment shown, well 28 extends into interior 68 of ferrule 18 and includes well sides 36 connecting ferrule outer end 22 to well base 30. In other embodiments, such as that shown in FIG. 5B, for example, well 28 is flush with ferrule outer end 22 and does not include well sides 36. Well base 30 includes inner side 32, which faces toward interior 68 of ferrule 18, and outer side 34, which faces away from interior 68. During the method of the present invention, bristle inner tips 42 (shown in FIGS. 5A and 5B) are disposed in contact with outer side 34 of well base 30 and welding is applied to inner side 32 of well base 30. This welding permanently integrates bristles 38 with ferrule 18. It is understood, however, that the bristles 38 may also be glued to well base 30.

Figure 3A:
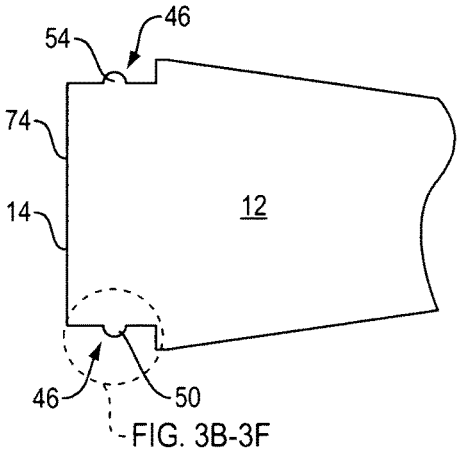
FIG. 3A is a partial side view of a handle of a makeup brush of the present invention.
Figure 2B:
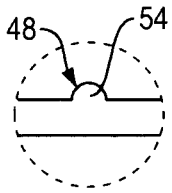
FIGS. 2B-2F are blown up views of several embodiments of connecting means on the ferrule shown in FIG. 2A.
Figure 3B:
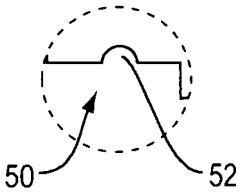
FIGS. 3B-3F are blown up views of several embodiments of connecting means on the handle shown in FIG. 3A, where the handle connecting means shown in FIGS. 3A-3F are releasably mateable with the ferrule connecting means shown in FIGS. 2A-2F, respectively.
Figure 3C:
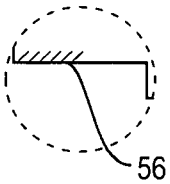

Still referring to FIG. 2A, on the right, we see an example of connecting means 46. Connecting means 46 are for connecting handle 12 and ferrule 18. In the preferred embodiment, as shown, the wall of the interior 68 of ferrule 18 includes an indentation 52, which is a ferrule snapping feature 48. Referring also to FIG. 3A, the remainder of the preferred connecting means 46 are shown in a partial side diagram of handle 12, in the form of handle snapping feature 50, which in this embodiment is protrusion 54, which releasably mates with indentation 52. One of ordinary skill in the art will recognize that there are several variations on this basic idea of ferrule and handle snapping features 48, 50. We now also refer to FIGS. 2B-2F and 3B-3F, which are exploded views of the sections of FIGS. 2A and 3A that are circled with dashed lines. For example, as shown in FIGS. 2B and 3B, ferrule snapping feature 48 may be protrusion 54 (as opposed to indentation 52 shown in FIG. 2B) and handle snapping feature 50 may be indentation 52.

Figure 2C:
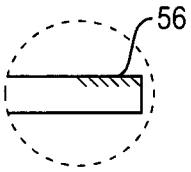
Figure 2D:
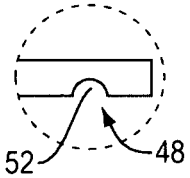
Figure 3D:
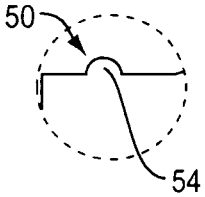
Figure 2E:
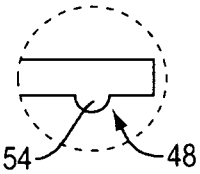
Figure 3E:
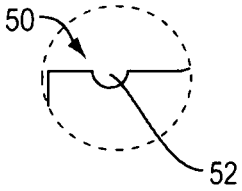
Figure 2F:
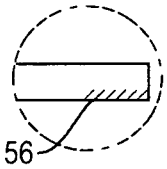
Figure 3F:
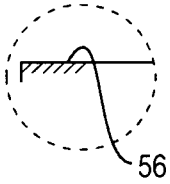
Figure 4A:
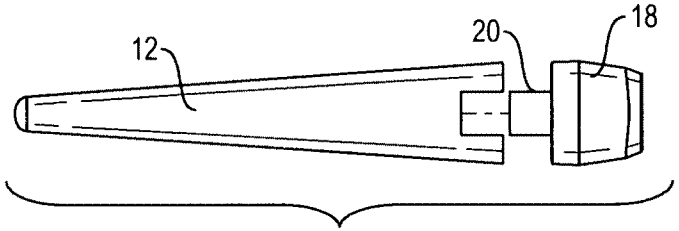
FIGS. 4A and 4B are side cutaway diagrams illustrating different ways that the ferrule and handle may fit together.
Figure 4B:
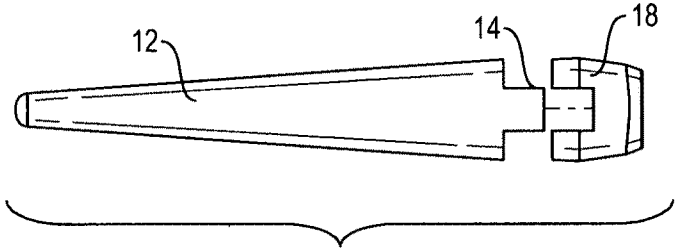

Referring now also to FIGS. 4A and 4B, side views of two versions of makeup brush 10 are shown. In FIG. 4A, ferrule 18 slips into handle 12, where dotted lines show where ferrule inner end 20 will set within handle 12. In FIG. 4B, handle 12 slips into ferrule 18, where dotted lines shown where ferrule end 14 of handle 12 will set within ferrule 18. In FIGS. 2A and 3A (together) and FIG. 4B, ferrule 18 and handle 12 are shown as preferred, where handle 12 will slip into ferrule 18, and, once unified, handle 12 and ferrule 18 will appear fairly flush with one another. As shown in FIG. 4A, however, another embodiment would have ferrule 18 slip into handle 12. In this embodiment, other variations of ferrule and handle snapping features 48, 50 are possible. For example, as shown in FIGS. 2D and 3D, as with FIGS. 2A and 3A, ferrule snapping feature 48 is indentation 52 and handle snapping feature 50 is protrusion 54, but unlike FIGS. 2A and 3A, indentation 52 is on the outside of ferrule 18 and protrusion 54 is on the inside of handle 12. Similarly, as shown in FIGS. 2E and 3E, like FIGS. 2B and 3B, ferrule snapping feature 48 is protrusion 54 and handle snapping feature 50 is indentation 52, but unlike FIGS. 2B and 3B, protrusion 54 is on the outside of ferrule 18 and indentation 52 is on the inside of handle 12.

Additionally, as shown in FIGS. 2C, 2F, 3C, and 3F, coordinating threading 56 may be included on the inside or outside of ferrule 18 and/or handle 12, such that ferrule 18 and handle 12 may be releasably screwed together, whether they are disposed as shown in FIG. 4A or 4B. Although snapping features 48, 50 and threading 56 are illustrated as the preferred connecting means 46, one of at least ordinary skill in the art will recognize that ferrule 18 and handle 12 may be releasably connected in many different manners, and each of these is considered to be within the scope of the present invention.

Figure 5B:
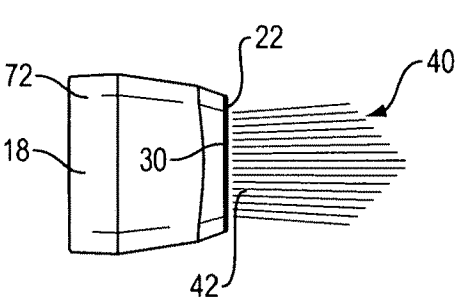
FIGS. 5A and 5B are side views of the ferrule showing a well disposed within the ferrule interior and a well flush with the ferrule outer end, respectively.
Figure 5A:
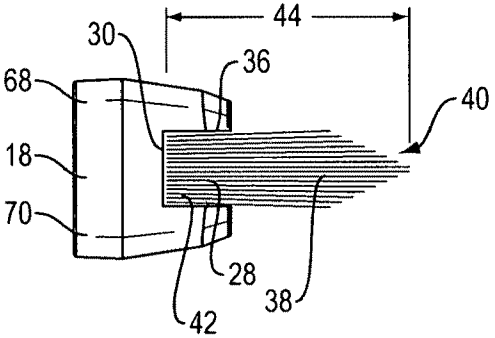

Now referring to FIGS. 5A and 5B, side views of ferrule 18 showing well 28 disposed within ferrule interior 68, and well 28 flush with ferrule outer end 22 are provided, respectively. In FIG. 5A, well 28 has well sides 36 that extend well 28 into interior 68 of ferrule 18. In FIG. 5B, well 28 has no depth and no well sides 36. Instead, well 28 is disposed directly at ferrule outer end 22. In both of FIGS. 5A and 5B, bristles 38 are attached at their bristle inner tips 42 to outer side 34 of well base 30 (shown most clearly in FIG. 2A) and a bristle length 44 extends out therefrom to bristle outer tips 40. Although it is preferred that well 28 include depth, as shown in FIG. 5A, having bristles 38 extend directly out from ferrule outer end 22, may be preferable for certain types of brushes. In such embodiments, practically speaking, well base 30 and ferrule outer end 22 are the same feature, but the details discussed above concerning how bristle inner tips 42 are disposed in contact with the outer side 34 of well base 30 and welding is applied to the inner side 32 of well base 30 are applicable in either of the embodiments shown in FIGS. 5A and 5B.

Figure 6B:
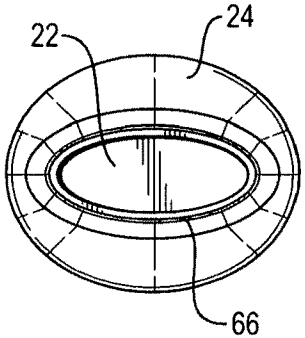
FIGS. 6A and 6B are top down views of the ferrule with circular and elliptical ferrule outer ends, respectively.
Figure 6A:
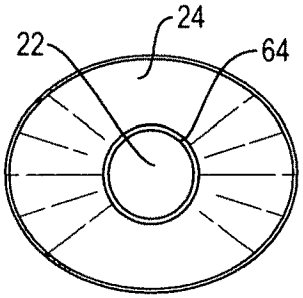

Now referring to FIGS. 6A and 6B, top down views of ferrule 18 with circular 64 and elliptical 66 ferrule outer ends 22 are provided, respectively. Ferrule inner end 20 is always the same shape and size as ferrule end 14 of handle 12, so that they may mate, and importantly, so that handle 12 may mate with any ferrule 18. Ferrule outer end 22 has no direct contact with handle 12, however, so it may accommodate different shapes, as shown in FIGS. 6A and 6B. It is understood that ferrule outer ends 22 may be any shape and the round shapes illustrated herein are merely exemplary.

Figure 7A:
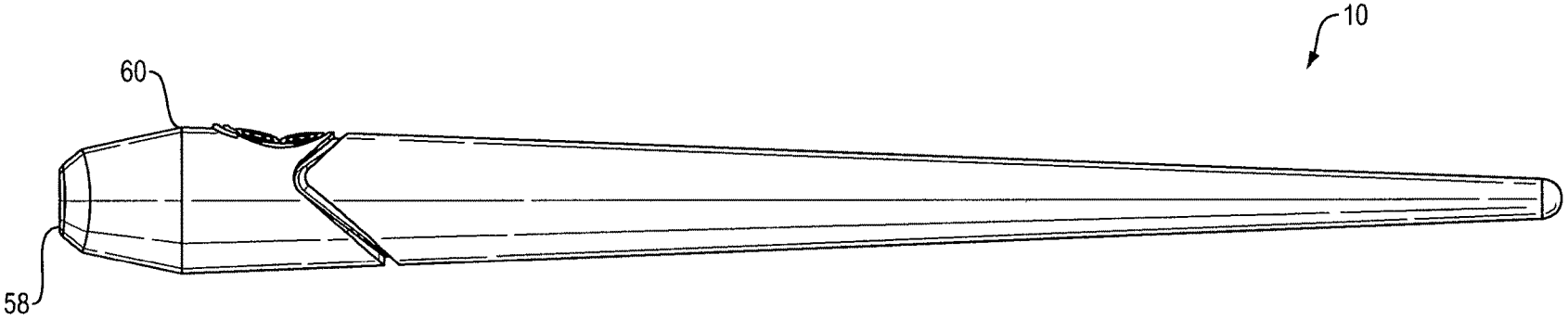
FIGS. 7A-7C are various views of one embodiment of the makeup brush of the present invention.
Figure 7C:
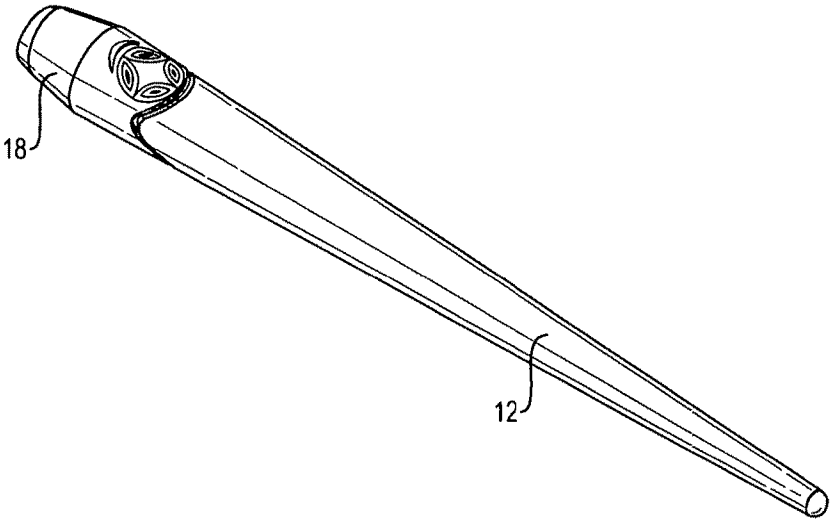
Figure 7B:
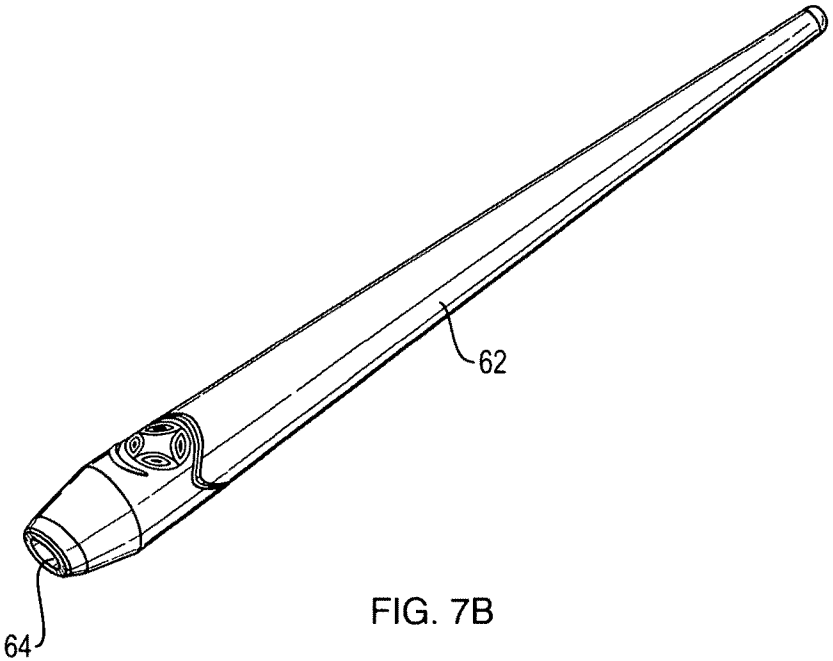
Figure 10C:
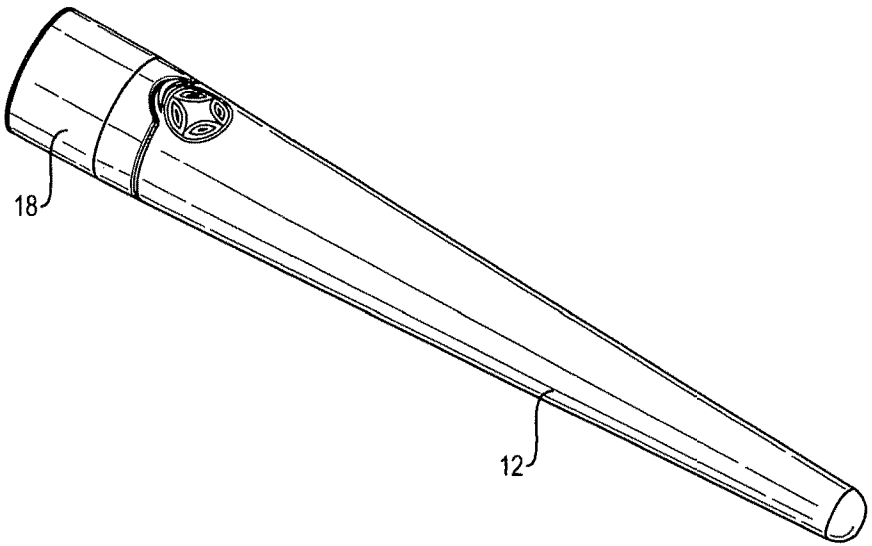

Now referring to FIGS. 7A-10C, various views of various embodiments of makeup brush 10 of the present invention are provided. The handles 12 of each embodiment are similar in length and similar in that they include tapering 62. The main differences are, instead, in the respective ferrules 18, as discussed below. FIGS. 7A-7C illustrate an eye liner brush according to the present invention. Ferrule outer end diameter 58 is less than ferrule inner end diameter 60, and ferrule outer end 22 has circular shape 64. FIGS. 8A-8C illustrate a foundation brush according to the present invention. Ferrule outer end diameter 58 is less than ferrule inner end diameter 60, and ferrule outer end 22 has elliptical shape 66. FIGS. 9A-9C illustrate blush brush according to the present invention. Ferrule outer end diameter 58 is less than ferrule inner end diameter 60, but the difference in the diameters 58, 60 is not as great as the difference illustrated in FIGS. 8A-8C, for example. Also like the makeup brush 10 shown in FIGS. 8A-8C, the blush brush shown in FIGS. 9A-9C has a ferrule outer end 22 with an elliptical shape 66. The minor axis of the elliptical shape 66 shown in FIG. 9B, however, is greater than the minor axis of the elliptical shape 66 shown in FIG. 8B, making the elliptical shape 66 shown in FIG. 9B rounder, or closer to being circular, than that shown in FIG. 8C. FIGS. 10A-10C illustrate a powder brush according to the present invention. In this embodiment, ferrule outer end diameter 58 and ferrule inner end diameter 60 are equal, and ferrule outer end 22 has circular shape 64. The makeup brushes 10 shown in FIGS. 7A-10C illustrate some of the variations possible within the scope of the present invention.

Figure 11:
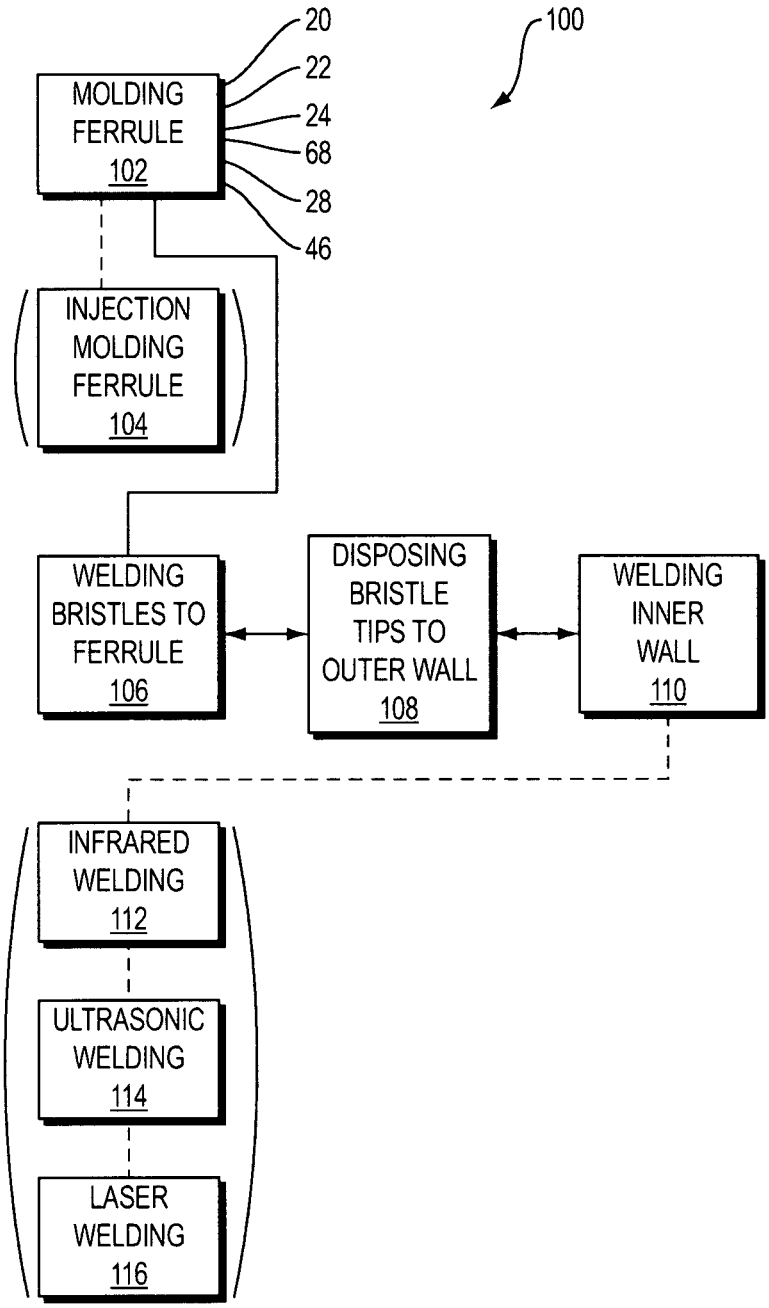
FIG. 11 is a flow chart identifying the steps of the method of the present invention.

Now referring to FIG. 11, a flow chart of method 100 of the present invention is provided. Method 100 includes molding the ferrule 102 and welding the bristles to the ferrule 106. The first step is molding ferrule 102. This step includes molding all of the required features of ferrule 18, including ferrule inner end 20, ferrule outer end 22, ferrule body 24, ferrule interior 68, ferrule well 28, and connecting means 46, all of which are discussed at length above. Although not all features of ferrule 18 may be listed here, it is understood that all features of ferrule 18 are molded in step 102. It is preferred that the step of molding ferrule is accomplished through injection molding 104. This step 104 is shown as dashed lines from step 102 and in parentheses to indicate that it is not a separate step from step 102, but a preferred manner of accomplishing step 102. In this context, injection molding has its common meaning within the art and analogous arts. That is to say, injection molding is a manufacturing process for producing parts by injecting molten material into a mold. In the present case, the molten material is preferably PBT or other elastomers or thermoplastic and thermosetting polymers, as discussed above.

The second step is welding bristles to the ferrule 106. This step 106 includes the substeps of disposing bristle tips to outer wall 108 and welding inner wall 110. Step 108 includes disposing the bristle inner tips 42 in contact with the outer side 34 of base well 30 (as shown, for example in FIGS. 2A and 5A). Step 110 includes applying welding to the inner wall 32 of base well 30 (shown in FIG. 2A). Step 110 is preferably accomplished through infrared welding 112, ultrasonic welding 114, or laser welding 116. Again steps 112, 114, and 116 are shown as dashed lines from step 110 and in parentheses to indicate that they are examples of accomplishing step 110, rather than separate steps. In this context, infrared welding has its common meaning within the art and analogous arts. That is to say, infrared welding is a non-contact thermal welding technique that heats thermoplastic parts to molten temperatures so that they may be permanently joined together. In this context, ultrasonic welding has its common meaning within the art and analogous arts. That is to say, ultrasonic welding is an industrial technique whereby high-frequency ultrasonic acoustic vibrations are locally applied to workpieces being held together to create a solid-state weld. It is commonly used for plastics, such as the polymers preferred in the current invention and discussed elsewhere herein. In this context, laser welding has its common meaning within the art and analogous arts. That is to say, laser welding or laser beam welding or LBW is a welding technique used to join pieces of metal or thermoplastics through the use of a laser. The laser beam provides a concentrated heat source, allowing for robust welds and high welding rates. Although the welding techniques described herein are preferred, one of ordinary skill in the art will recognize that other welding techniques common in the art may be substituted.

Figure 12A:
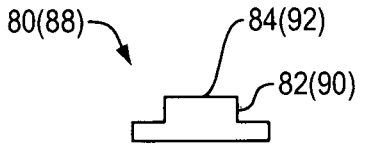
FIG. 12A is one side view of a disc of the present invention with an alignment tab.
Figure 12B:
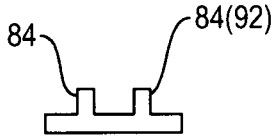
FIG. 12B is an alternate side view of a disc of the present invention with two alignment tabs.
Figure 12C:
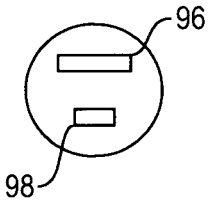
FIG. 12C is a top down view of a disc of the present invention with two different sized alignment tabs.

Now referring to FIGS. 12A-12C, various views of a disc with alignment tabs are provided. Although labeled as ferrule disc 80 with ferrule guiding feature 82 that is ferrule alignment tabs 84, it is understood that this could also be a handle disc 88 with handle guiding feature 90 that is handle alignment tabs 92. In FIG. 12A, a side view of ferrule disc 80 is provided and the ferrule guiding feature 82 is ferrule alignment tab 84. This ferrule disc 80 may include only the single ferrule alignment tab 84. Alternatively, FIG. 12B provides an alternate side view of ferrule disc 80 if it included two ferrule alignment tabs 84 and were swiveled 90° from the position shown in FIG. 12A. In FIG. 12C, a top down view of ferrule disc 80 is provided and the ferrule alignment tabs 84 are shown to have different first and second sizes 96, 98. The different sizes 96, 98 ensure that the handle 12 and ferrule 18 may only be connected in one orientation.

Figure 13A:
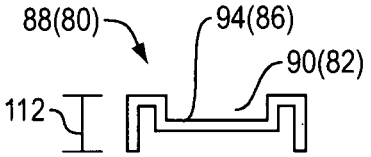
FIG. 13A is a side cutaway view of a disc of the present invention with depth and an alignment slot.
Figure 13B:
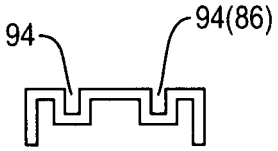
FIG. 13B is an alternate side cutaway view of a disc of the present invention with depth and two alignment slots.
Figure 13C:
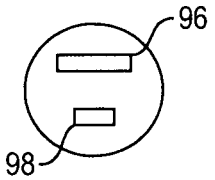
FIG. 13C is a top down view of a disc of the present invention with depth and two different sized alignment slots.
Figure 13D:
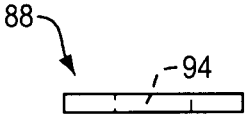
FIG. 13D is a side view of an alternate disc of the present invention with an alignment slot.

Now referring to FIGS. 13A-13E, various views of a disc with alignment slots are provided. Again, although labeled as handle disc 88 with handle guiding feature 90 that is handle alignment slots 94, it is understood that this could also be a ferrule disc 80 with ferrule guiding feature 82 and ferrule alignment slots 86. In FIGS. 13A-13B, handle disc 88 has disc depth 112. In such embodiments, the entire handle alignment slot 94 is molded into the handle disc 88. This is compared with FIGS. 13D-13E that show flat handle disc 88, where handle alignment slot 94 extends all the way through handle disc 88. (It is understood that this flat embodiment of handle disc 88 is not without depth, but its depth is less than disc depth 112, making this handle disc 88 more of a flat disc like a compact disc.) The handle alignment slots 94 shown in FIGS. 13A, 13B, 13D, and 13E are sized and dimensioned to mate with ferrule alignment tabs 84, as shown in FIGS. 12A and 12B. In FIG. 13C, a top down view of handle disc 88 is provided, indicating the different sizes 96, 98 of handle alignment slots 94, similar to the ferrule alignment tabs 84 shown in FIG. 12C.

Figure 14A:
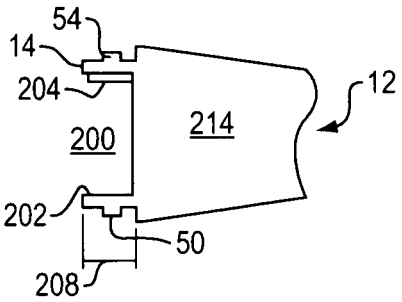
FIG. 14A is a side cutaway view of an alternate version of a handle of the present invention, as compared with FIG. 3A.
Figure 13E:
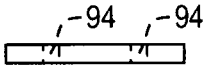
FIG. 13E is a side view of an alternate disc of the present invention with two alignment slots.
Figure 14B:
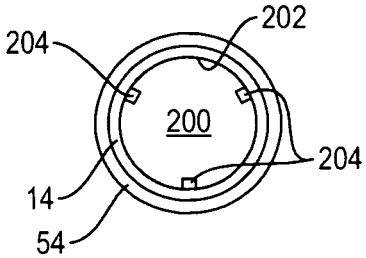
FIG. 14B is a top down view of the alternate version of the handle shown in FIG. 14A.
Figure 14C:
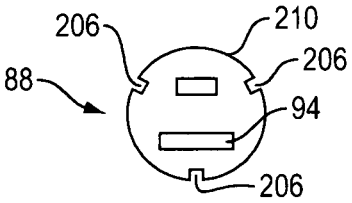
FIG. 14C is a top down view of a handle disc that is mateable with the handle shown in FIGS. 14A and 14B.

Now referring to FIG. 14A, an alternate embodiment of handle 12 is provided and may be compared with FIG. 3A. Unlike in FIG. 3A, handle 12 does not include handle cap 74. Also unlike in FIG. 3A, handle 12 includes barrel space 200 behind ferrule end 14 extending a barrel depth 208 into handle body 214, which is the body of the handle 12 between ferrule end 14 and holding end 16. Barrel space 200 has barrel wall 202, which faces inward. It is preferred that barrel wall 202 include at least one barrel guide 204. Barrel guide 204 is preferably a protrusion extending slightly inward from the barrel wall 202, as shown. Now referring to FIG. 14B, a top down view of the handle 12 shown in FIG. 14A is provided, looking down on the handle 12 with ferrule end 14 facing up. In this view, the preferred three barrel guides 204 are shown extending into barrel space 200 from inward-facing barrel wall 202. Now referring to FIG. 14C, a top down view of handle disc 88 that would be attached to handle 12 shown in FIGS. 14A and 14B is provided. Handle disc 88 includes disc guides 206 extending inward from disc perimeter 210. Disc guides 206 are sized and dimensioned to mate with barrel guides 204 so that disc perimeter 210 is held snugly within barrel wall 202. Although handle alignment slots 94 are labeled in handle disc 88, it is understood that these could also be handle alignment tabs 92.

Figure 15A:
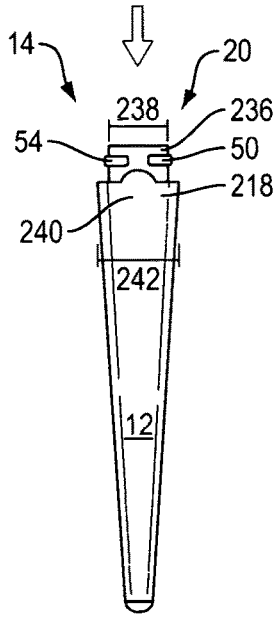
FIG. 15A is a side view of an embodiment of the handle of the present invention.
Figure 16A:
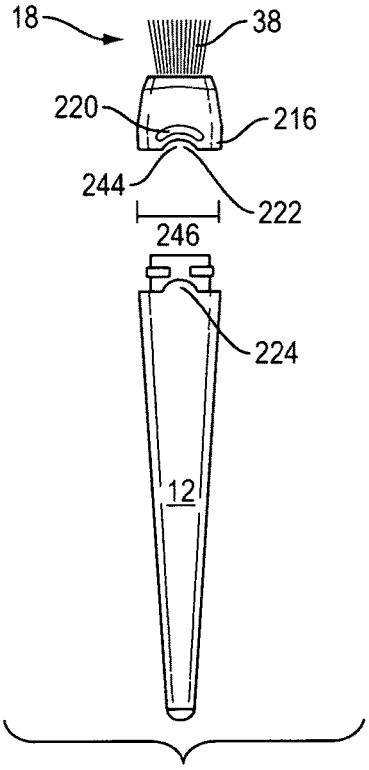
FIG. 16A is a side view of a makeup brush of the present invention with the handle and the ferrule separated.

Now referring to FIG. 15A, a side view of a preferred handle 12 is provided. Ferrule end 14 has narrow portion 236 with narrow portion diameter 238 and wide portion 240 with wide portion diameter 242. Narrow portion diameter 238 is less than wide portion diameter 242. Wide portion 240 forms handle lip 218. As shown in FIG. 16A below, ferrule 18 has ferrule lip 216 with ferrule lip diameter 246. Wide portion diameter 242 and ferrule lip diameter 246 are equal so that makeup brush 10 has a smooth, flush appearance and feeling when ferrule 18 and handle 14 are connected.

Figure 15B:
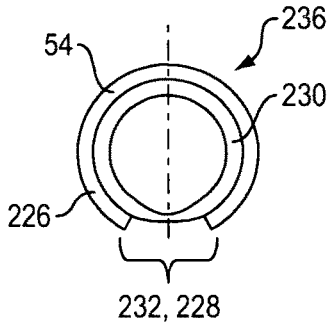
FIG. 15B is a top down view of the embodiment of the handle as shown in FIG. 15A, along the view of the arrow.
Figure 15C:
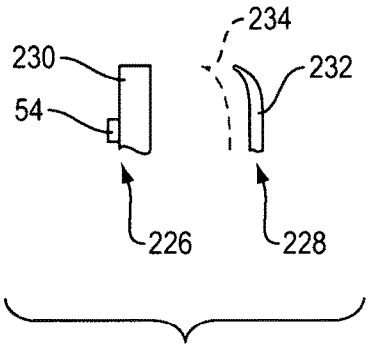
FIG. 15C is a side cutaway view of the embodiment of the handle as shown in FIG. 15B, along the dashed line.

Now referring to FIG. 15B, a top down view of handle 14 along the arrow in FIG. 15A is provided. It is understood that handle lip 218 is likely visible from this point of view, but has been eliminated in the illustration in order to clarify other features. In this view, we see narrow portion 236 from the top. Narrow portion 236 includes narrow portion wall 230. Protrusion 54 extends out from narrow portion wall 230 only at protrusion section 226, leaving empty section 228 along narrow portion wall 230 where protrusion 54 is not present. At this empty section 228, the narrow portion wall 230 has a thinning 232. The difference in thickness along the narrow portion wall 230 may be exaggerated in this view for illustrative purposes. Now referring to FIG. 15C, a cutaway view of narrow portion 236 along the dotted line shown in FIG. 15B is provided. On the left, narrow portion wall 230 is thicker at the protrusion section 226 from which protrusion 54 extends (again, the variation between the thick narrow portion wall 230 on the left and the thinning 232 on the right may be exaggerated for illustration). On the right, empty section 228 has the thinning 232. It also curves slightly inward along a radius 234. The lack of the protrusion 54 in the empty section 228; the thinning 232 of empty section 228; and the curving slightly inward along a radius 234 of the empty section 228 all aid in making it easier to separate the ferrule 18 and the handle 12 at the empty section 228.

Figure 16B:
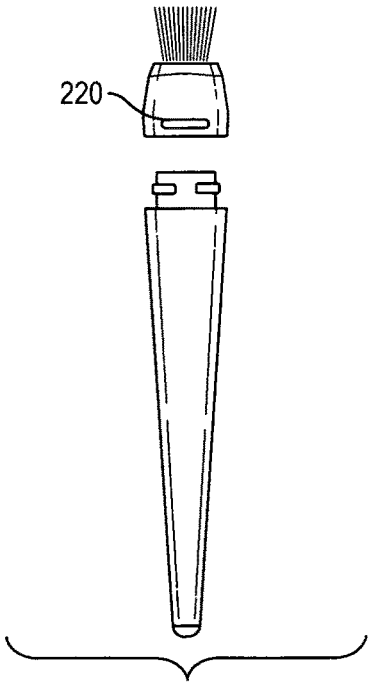
FIG. 16B is a side view of an alternate version of the makeup brush of the present invention with the handle and the ferrule separated.

Now referring to FIGS. 16A and 16B, further features for easing the separation are provided. As shown in FIG. 16A, ferrule lip 216 includes cutout 222 with a certain shape 244. Handle lip 218 includes a similar disruption from its solid line with a coordinating filler 224 that is sized and dimensioned to mate with cutout 222. In embodiments that include the empty section 228 and thinning 232, as discussed above, the filler 224 of the handle lip is disposed proximate to the empty section 228 of the narrow portion 236. Although the thinning 232 of the empty section 228 occur on narrow portion 236 of ferrule end 14 of handle 12, and the filler 224 is disposed on the handle lip 218 that is the wide portion 240 of ferrule end 14 of the handle 12, as used herein, to say that the filler 224 is proximate to the empty section 228 is to say that the filler 224 is positioned on the perimeter of the handle lip 218 that is just below the position on the perimeter of the narrow portion 236 that has the thinning 232. Although shown as the words would imply, with cutout 222 being an indentation cutaway from ferrule lip 216 and filler 224 being an added shape that can fill the indentation, it is understood that these designations are arbitrary and the cutout 222 of the ferrule lip 216 may be the added shape that fills the indentation of the filler 224 of the handle lip 218. Cutout 222 and filler 224 guide handle 12 and ferrule 18 into a preferred orientation. Ferrule lip 216 also preferably includes a thumb eyebrow 220 just above the cutout 222. The thumb eyebrow 220 is a small protrusion out from the ferrule lip 216 and preferably follows a shape 244 of the cutout 222. As shown, for example, thumb eyebrow 220 is curved to follow the curved shape 244 of cutout 222. In FIG. 16B, an embodiment is shown that does not include cutout 222 and filler 224, but does include thumb eyebrow 220, which in this embodiment, is flat and parallel with the ferrule lip 216 above which the thumb eyebrow 220 is directly disposed.

Figure 17:
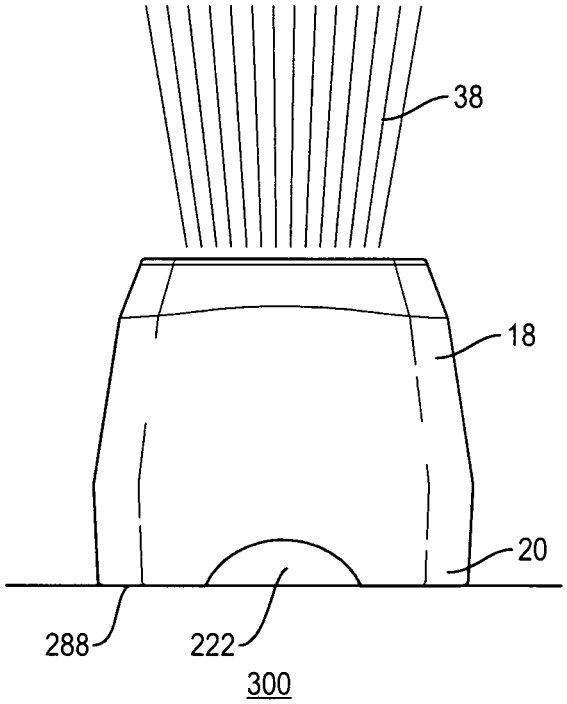
FIG. 17 is a side view of a ferrule of the present invention with a ferrule inner end that includes a flat base.

Now referring to FIG. 17, a side view of ferrule 18 with ferrule inner end 20 including flat base 288 is provided. Flat base 288 allows ferrule 18 to stand up on its own on a flat surface 300. The inclusion of cutout 222 does not interfere with this capability.

Although the present invention has been described in considerable detail with reference to certain preferred versions thereof, other versions would be readily apparent to those of ordinary skill in the art. Therefore, the spirit and scope of the description should not be limited to the description of the preferred versions contained herein.

I claim:

1. A makeup brush comprising:

a handle with a ferrule end and a holding end;

a ferrule comprising:

a ferrule inner end connectable to said ferrule end of said handle;

a ferrule outer end;

an interior;

a ferrule body with a ferrule length extending between said inner and outer ends and around said interior; and a well disposed at said ferrule outer end, wherein said well comprises a well base parallel to said ferrule outer end, wherein said well base comprises an inner side that faces toward said interior of said ferrule body and an outer side that faces away from said interior of said ferrule; and a plurality of bristles, wherein:

each of said bristles comprises a bristle outer tip, a bristle inner tip, and a bristle length extending between said bristle outer and inner tips;

said bristles extend out of said ferrule; and said inner tips of said bristles are integrally attached to said outer side of said well base of said ferrule;

wherein:

said ferrule inner end of said ferrule is releasably connected to said ferrule end of said handle;

said ferrule comprises a ferrule snapping feature that releasably mates with a handle snapping feature disposed on said handle;

said ferrule snapping feature is one of an indentation in or a protrusion from said ferrule body and said handle snapping feature is an other of a protrusion from or an indentation in said handle, wherein said indentation and said protrusion are releasably snapped with one another;

said ferrule further comprises a ferrule disc disposed within said interior of said ferrule body parallel to said well base, wherein said ferrule disc comprises at least one ferrule disc guiding feature;

said handle further comprises a handle disc disposed on said ferrule end of said handle, wherein said handle disc comprises at least one handle disc guiding feature; and said at least one ferrule disc guiding feature and said at least one handle disc guiding feature are sized and dimensioned to mate so as to guide said handle and said ferrule into proper alignment for connection.

2. The makeup brush as claimed in claim 1, wherein said at least one ferrule disc guiding feature is at least one ferrule alignment tab protruding from said ferrule disc into said interior of said ferrule body toward said ferrule inner end and said at least one handle disc guiding feature is at least one handle alignment slot disposed through said handle disc, wherein said at least one ferrule alignment tab is sized and dimensioned to mate with said at least one handle alignment slot.

3. The makeup brush as claimed in claim 2, wherein said at least one ferrule alignment tab is two ferrule alignment tabs of different sizes and said at least one handle alignment slot is two handle alignment slots of different sizes.

4. The makeup brush as claimed in claim 1, wherein said at least one ferrule disc guiding feature is at least one ferrule alignment slot disposed through said ferrule disc and said at least one handle disc guiding feature is at least one handle alignment tab protruding from said handle disc away from said ferrule end of said handle, wherein said at least one ferrule alignment slot is sized and dimensioned to mate with said at least one handle alignment tab.

5. The makeup brush as claimed in claim 4, wherein said at least one ferrule alignment slot is two ferrule alignment slots of different sizes and said at least one handle alignment tab is two handle alignment tabs of different sizes.

6. The makeup brush as claimed in claim 1, wherein said ferrule disc is integral to said ferrule within said interior of said ferrule.

7. The makeup brush as claimed in claim 1, wherein said ferrule disc is attached to said ferrule within said interior of said ferrule.

8. The makeup brush as claimed in claim 1, wherein said handle disc is integral to said ferrule end of said handle.

9. The makeup brush as claimed in claim 1, wherein said handle disc is glued to said ferrule end of said handle.

10. The makeup brush as claimed in claim 1, wherein said handle disc is welded to said ferrule end of said handle.

11. The makeup brush as claimed in claim 1, wherein:

said handle further comprises a barrel space disposed behind said ferrule end extending into said ferrule body;

said barrel space comprises an inward-facing barrel wall;

said barrel wall comprises at least one barrel guide;

said handle disc comprises a disc perimeter;

said disc perimeter comprises at least one disc guide; and said at least one barrel guide and said at least one disc guide are sized and dimensioned to mate such that said disc perimeter fits snugly within said barrel wall.

12. The makeup brush as claimed in claim 11, wherein said at least one barrel guide is a protrusion extending inward from said barrel wall and said at least one disc guide is an indentation extending into said disc perimeter.

13. The makeup brush as claimed in claim 1, wherein said integral attachment of said inner tips of said bristles to said outer side of said well base of said ferrule is glue.

14. The makeup brush as claimed in claim 1, wherein said integral attachment of said inner tips of said bristles to said outer side of said well base of said ferrule is achieved through welding.

15. The makeup brush as claimed in claim 1, further comprising a brush length extending between said ferrule outer end of said ferrule and said holding end of said handle, wherein said ferrule has a ferrule length and said ferrule length is less than or equal to 25% of said brush length.

16. The makeup brush as claimed in claim 15, wherein said ferrule length is less than or equal to 20% of said brush length.

17. The makeup brush as claimed in claim 1, wherein said ferrule inner end of said ferrule comprises a flat base.

18. A makeup brush comprising:

a handle with a ferrule end and a holding end;

a ferrule comprising:

a ferrule inner end connectable to the ferrule end of the handle;

a ferrule outer end;

an interior;

a ferrule body with a ferrule length extending between the inner and outer ends and around the interior; and a plurality of bristles, wherein:

each of the bristles comprises a bristle outer tip, a bristle inner tip, and a bristle length extending between the bristle outer and inner tips; and the bristles extend out of the ferrule outer end of the ferrule;;

wherein:

the handle is substantially circular in cross section and tapers in diameter along at least a portion a length extending from the ferrule end to the holding end;

the handle comprises a narrow portion at the ferrule end that is narrower in diameter than an immediately adjacent portion;

the ferrule inner end of the ferrule is releasably connected to the ferrule end of the handle;

the ferrule comprises a ferrule snapping feature configured to releasably mate with a handle snapping feature provided on the handle; and the ferrule snapping feature comprises an indentation in the ferrule and the handle snapping feature comprises a protrusion from the handle, wherein the indentation and the protrusion are configured to be releasably snapped with one another.

19. The makeup brush as claimed in claim 18, wherein the handle comprises at least two protrusions on the narrow portion of the handle.

20. The makeup brush as claimed in claim 18, wherein the handle comprises a protrusion extending around the narrow portion of the handle.

* * * * *